United States Patent [19]

Griesdorn

[11] Patent Number: 4,504,004

[45] Date of Patent: Mar. 12, 1985

[54] SHEET FORMING MACHINE

[75] Inventor: Carl P. Griesdorn, Cincinnati, Ohio

[73] Assignee: Planet Products Corporation, Cincinnati, Ohio

[21] Appl. No.: 437,568

[22] Filed: Oct. 29, 1982

[51] Int. Cl.[3] ..... B65H 17/36

[52] U.S. Cl. ..... 226/150; 226/162

[58] Field of Search ..... 226/149, 150, 158, 162; 83/277

[56] References Cited

U.S. PATENT DOCUMENTS

| | | | |
|---|---|---|---|
| 1,375,889 | 4/1921 | Baltzley | 226/149 |
| 2,755,085 | 7/1956 | Giani | 226/162 X |
| 3,425,611 | 2/1969 | Zelnick | 226/162 |
| 4,177,892 | 12/1979 | Jesperson | 226/162 X |

*Primary Examiner*—Stuart S. Levy
*Assistant Examiner*—Katherine Jaekel
*Attorney, Agent, or Firm*—Kinney and Schenk

[57] ABSTRACT

An improved sheet forming machine and method of making same are provided wherein such machine employs a first set of clamp assemblies and associated moving devices for serially moving the sheet or sheet material along fixed parallel rails through a succession of working stations and a second set of clamp assemblies which cooperate with the first set of clamp assemblies in a non-interfering manner and grasp and hold opposite side edge portions of the sheet material the full extent of the stations along the rails, and the second set of clamp assemblies are adapted to provide precise grasping and holding of such opposite side edge portions of the sheet material along such full extent to enable modification of the sheet material at each successive station with optimum precision. The machine also has improved apparatus for adjusting and holding the distance between the parallel rails.

3 Claims, 8 Drawing Figures

SHEET FORMING MACHINE

BACKGROUND OF THE INVENTION

1. Field of the Invention

This invention relates to the forming of sheet material, including sheet material which is stretchable both axially and transverse the axis thereof, and in particular to an improved sheet forming machine and method of making such a machine.

2. Description of the Prior Art

It is known in the art to provide a forming machine for sheet material and method of making such a forming machine wherein the sheet material is advanced serially through a succession of working stations for physical modification of such sheet material and with the machine comprising, a pair of spaced apart rails extending along the stations, a pair of first clamp assemblies each mounted on an associated one of said rails for reciprocating movements therealong, with the first clamp assemblies being adapted to grasp opposite side edge portions of the sheet material and upon moving the first clamp assemblies in one direction along the rails advance the sheet material through the stations, means for moving the first clamp assemblies along the rails, a plurality of second clamp assemblies mounted on the rails in longitudinally fixed relation with each of the second clamp assemblies having an upper and a lower clamp member for grasping an associated side edge portion of the sheet material transversely inwardly, independently, and in a non-interfering manner with an associated one of the first clamp assemblies and such a machine and method of making same are disclosed in U.S. Pat. No. 3,425,611.

However, a machine as disclosed in the above-mentioned patent has certain limitations in that it is slow in operation, uses a plurality of second clamp members of the character mentioned above along each rail which grasp only small axial increments of the side edge portions of the sheet material, and lacks apparatus for precisely adjusting and holding the rails. The grasping of only small increments of the side portions often results in slippage of the sheet material during physical modification thereof and in addition to slippage the physical modification of shrinkable plastic material, for example, may result in substantial distortion during such modification. However, any slippage or distortion (such as by stretching) at a working station results in misalignment at a subsequent station whereby an article such as a package made in the machine disclosed above may have poorly defind portions or parts.

SUMMARY OF THE INVENTION

This invention provides an improved forming machine for sheet material which overcomes the above-mentioned limitations.

In such an improved forming machine sheet material is advanced serially through a succession of working stations for physical modification of such sheet material in an optimum manner. The improved machine comprises a pair of spaced apart rails extending along the stations, a pair of first clamp assemblies each mounted on an associated one of the rails for reciprocating movements therealong with the first clamp assemblies being adapted to grasp opposite side edge portions of the sheet material and upon moving the first clamp assemblies in one direction along the rails advance the sheet material through the stations, means for moving the first clamp assemblies along the rails, and a plurality of second clamp assemblies mounted on the rails in longitudinally fixed relation with each of said second clamp assemblies having an upper and lower clamp member for grasping an associated side edge portion of the sheet material transversely inwardly, independently, and in a non-interfering manner with an associated one of the first clamp assemblies.

In accordance with one embodiment of the improved machine of this invention the upper and lower clamp members of each of the second clamp assemblies extend in a continuous uninterrupted manner substantially the full extent of the working stations along the rails and are adapted to provide precise grasping and holding of opposite side edge portions of the sheet material along such full extent to enable modification of the sheet material at each successive station with optimum precision.

In accordance with another embodiment of the improved machine of this invention an improved apparatus is provided for adjusting and holding the distance between the rails.

Accordingly, it is an object of this invention to provide an improved forming machine of the character mentioned.

Another object of this invention is to provide an improved method of making a forming machine of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DETAILED DESCRIPTION

Figure 1:
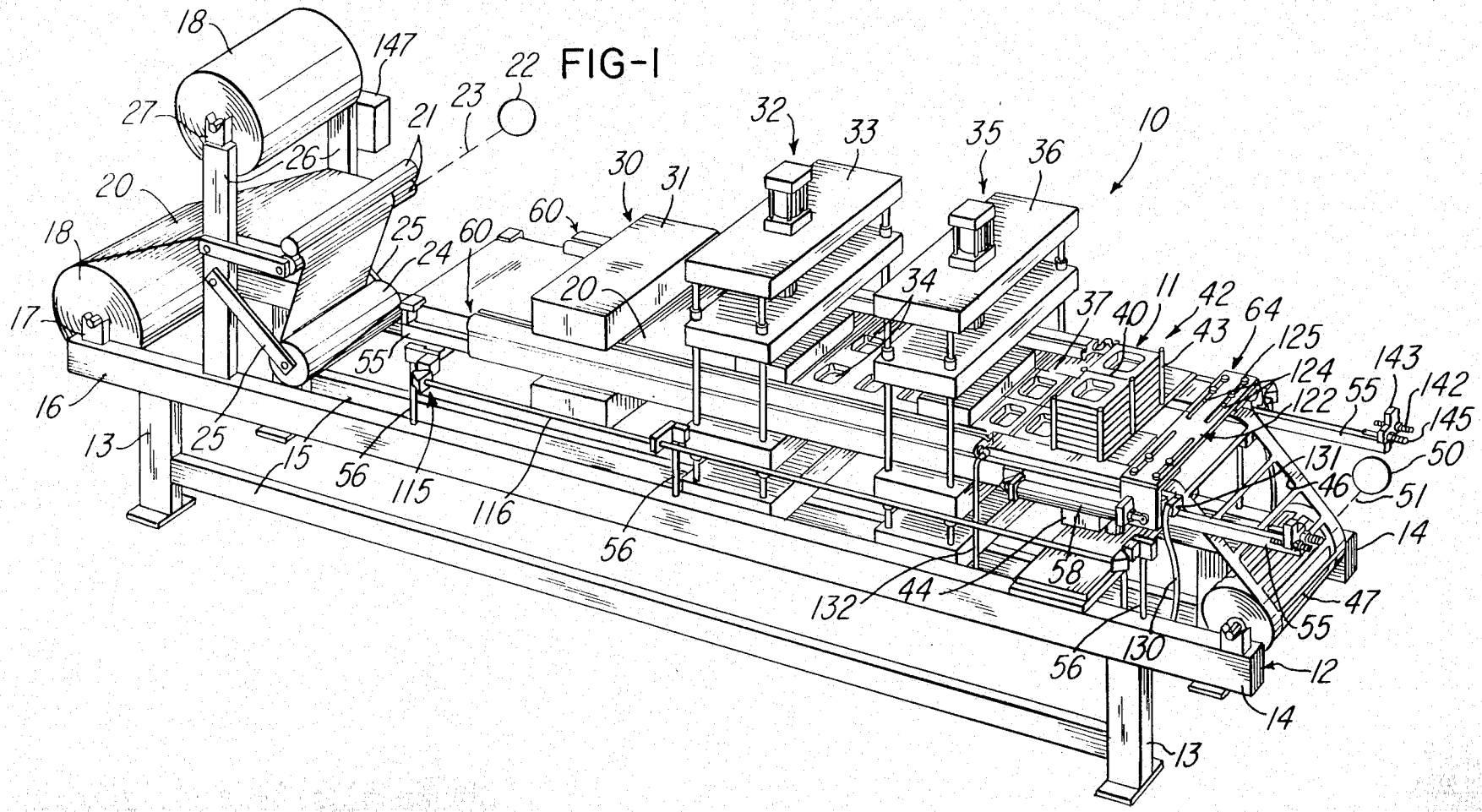
FIG. 1 is an isometric view with parts broken away and other parts shown schematically illustrating one exemplary embodiment of the machine of this invention and wherein such machine comprises a pair of parallel spaced apart rails extending along a succession of working stations and beyond opposite ends of such stations.

Reference is now made to FIG. 1 of the drawings which illustrates one exemplary embodiment of the improved forming machine of this invention and such machine is designated generally by the reference numeral 10. The machine 10 is very similar to the machine illustrated in the above-mentioned U.S. Pat. No. 3,425,611 and the basic disclosure of said patent is incorporated herein by reference thereto. It will also be appreciated that parts of the disclosure of such patent are basically repeated (though generally using different reference numerals) in this specification to facilitate understanding of this invention. Further, those portions of the machine 10 which are substantially different from corresponding portions of the machine described in the patent will be described in detail herein.

The forming machine 10 of this disclosure will now be illustrated and described in connection with the forming of a web or sheet of thermoplastic material, or the like, to define packages or containers 11 consisting of a pair of side-by-side hingedly fastened hat-shaped portions. The construction and arrangement of these portions is such that a suitable article may be disposed in one or both of the portions for transportation, display, storage, or use as a serving dish, or the like.

The machine 10 comprises an elongated frame 12 which is supported by a plurality of spaced apart supporting legs or columns 13. The frame 12 is comprised of a pair of longitudinally extending support beams, each designated by the same reference numeral 14, and suitable cross structures between such beams. Each support beam 14 is supported at its opposite end portions by a pair of columns or legs 13; and, the lower portions of such pair of legs 13 are stabilized and held together by an associated horizontal beam 15 fixed thereto.

The suport beams 14 have rearwardly extending portions 16 which provide supports 17 thereon for rotatably supporting a roll 18 of sheet material 20 which is to be formed by the machine 10. The sheet material 20 is often popularly referred to as a web 20 and is passed through a pair of cooperating rolls each designated by the same reference numeral 21 which engage the sheet material firmly therebetween. The lower one of the rolls 21 in this example is driven by a drive motor 22 through a mechanical drive connection 23 to provide controlled unwinding of such sheet material from its supply roll 18.

The sheet material 20 is then moved around a tensioning or dancer roll 24 which serves to provide controlled tension on such sheet material after unwinding thereof by movement through the rolls 21; and, the dancer roll 24 is suitably rotatably supported on a pair of arms 25 provided at opposite ends thereof. The inner ends of the arms are pivotally supported on a pair of support columns 26.

Each support column 26 is supported on an associated horizontal beam 14 and has a V-shaped support block 27 fixed to the upper end thereof. The support blocks 27 support another supply roll 18 which is kept in readiness for movement onto the supports 17 after the supply roll 18 being unwound is depleted and removed from its supports 17. Once the upper supply roll 18 is moved in position on supports 17 for unwinding, a new supply roll 18 is again placed on the support blocks 27 so that the above-described procedure can be repeated with minimum down time for the machine 10.

After the sheet material 20 is moved from beneath the dancer or tensioning roll 24 it is moved through a succession of working stations; and, at these working stations steps or operations are carried out which provide physical modification of the sheet material 20. The physical modification, in this example, results in the provision of packages or containers 11 having precisely defined portions. Indeed it has been found that the dimensional tolerances between successive containers made by the machine 10 is within roughly 0.005 inch for any dimension chosen to be measured.

In this example of the invention, the first station encountered after movement of the sheet material past the dancer roll 24 is a preheating station 30 at which station a portion of the sheet material is softened, as desired. At station 30 softening action is provided using any suitable heating means known in the art, such as, a heat tunnel 31, or the like. The softening of the sheet material is for the purpose of enabling such sheet material 20 to be formed in an easier manner.

The softened portion of sheet material or web 20 is then advanced to a forming station 32 and at the forming station a forming apparatus 33 is provided which has suitable cooperating components or dies which form the softened portion. In this example of the invention the apparatus 33 defines a substantially identical pair of side-by-side cup-shaped portions 34 in the softened portion of the sheet material. The apparatus 33 may be of any suitable type such as a press, or the like. In addition, the apparatus 33 may employ perforated metal dies (or the like) and use differential air pressure to draw portions of the softened sheet material over such perforated dies while sealing the peripheral edges of the softened sheet material 20 and thereby provide forming of such sheet material.

The machine 10 also has a severing and scoring station 35 which is provided with a suitable scoring and severing apparatus 36. The apparatus 36 engages the sheet material surrounding the cup-shaped portions 34 severing some substantially about the entire periphery of portions 34 while leaving a comparatively few connected or unsevered ticks or parts, such as parts 37, at opposite ends of portions 34 which enable the now formed and basically severed package 11 to be moved for further processing. The apparatus 36 also provides a central score line 40 basically dividing the package 11 in substantially identical halves. The score line 40 enables the package 11 to be bi-folded so that the package portions 34 are in overlying relation whereby a completely enclosed container may be defined. It will also be appreciated that a suitable tongue and slit (not shown) may be provided by the apparatus 36 to define integral locking means for the package 11, if desired.

The sheet material is then moved to stacking station 42 which for the purpose of this disclosure is not considered a working station. This approach has been taken because each severed container 11 could be removed as it exits the station 36. Nevertheless at station 42 a plurality of the packages 11 are stacked in nested relation and for stacking purposes a plurality of vertically disposed stacking rods 43 are provided to confine the packages 11. A pusher assembly 44 is provided and disposed beneath the sheet material and operates in a known manner to push each completed package 11 upwardly through a horizontal plane of the sheet material. Each package 11 is pushed upwardly past cooperating spring loaded rods or arms (not shown), of conventional known construction which hold the stacked and nested packages 11 in position above the plane of the sheet material 20, as shown in FIG. 1.

Each completed package 11 is moved precisely and directly beneath the stacked packages 11 at stacking station 42 whereupon the apparatus 44 pushes the package 11 last severed by apparatus 36 upwardly severing the ticks 37 which hold same to the sheet material. The last severed and scored package 11 is thus disposed in nested relation at the bottom of the stack of packages 11 at the stacking station 42 and simultaneously moved with the entire stack past the spring loaded arms which hold all packages thereabove as is known in the art. The stacked packages 11 may then be removed individually or more than one at a time using manual or automatic means.

As each package 11 is removed from the web or sheet material 20 it leaves a substantially rectangular cutout 46 therein whereby the cut sheet or web 20 is wound to define a scrap roll 47 thereof. The winding action in this example is provided by a drive motor 50 which is suitably connected by a mechanical drive connection 51 to the shaft of the scrap roll 47. Once a roll 18 of sheet material 20 is exhausted by running all of such material completely through the machine 10 the corresponding scrap roll 47 is removed and a new scrap roll started with each new supply roll 18.

The machine 10 of this invention is used to define packages 11 each comprised of two side-by-side cup-shaped portions hingedly fastened together by a score line 40 in the package 11. However, it will be appreciated that instead of defining packages 11 as disclosed herein other packages may be defined by modifying the machine as required. For example, packages as described in the above-mentioned U.S. patent may also be made; however, if made by the machine 10 the packages of such United States patent would be made with greater precision.

It is well-known that in the operation of a machine of the type disclosed herein, the sheet material 20 should be conveyed through the entire machine and in particular through the succession of working stations in a uniform manner and without binding or twisting. Further, it is important that the sheet material within the working stations of the machine be firmly gripped along opposite side edge portions thereof to assure precise working at such stations.

The machine 10 has a conveyor system which operates by grasping opposite side edge portions of the sheet material 20 and then advancing such sheet material in an indexing manner through such machine. After a sufficient amount of material 20 has been moved into the machine so that a part ready to be further formed is at each working station the conveyor system operates and indexes a new length of sheet material 20 to be preheated into station 30, the material preheated at station 30 is moved into the forming station 32, the formed material at station 32 is moved into the severing and scoring station 35, and the material at station 35 is moved into the stacking station 42. In this manner only a small length of sheet material 20 is introduced into the machine 10 with each indexing movement of the conveyor of the machine.

The machine 10 is provided with two sets of clamp assemblies. One of such sets of clamp assemblies is movable and comprises a conveyor proper for the machine while the other set is fixed and serves to firmly clamp the sheet material during return movement of the first set of clamp assemblies thereby providing several advantages for the machine 10 over previous machines and as will be described subsequently.

The machine 10 comprises a pair of spaced apart rails each designated by the same reference numeral 55 which extend along sheet material working stations 30, 32, and 35 as well as along stacking station 42 and beyond opposite ends of such stations. The rails 55 are suitably supported in a horizontal plane above the horizontal plane of support beams 14 by a plurality by suitable support means including a plurality of support rods 56 with only a representative few of such rods being designated by the reference numeral 56.

The machine also has a pair of first clamp assemblies each designated by the same reference numeral 57 (FIG. 4) and each clamp assembly 57 is mounted on an associated one of the rails 55 for reciprocating movements therealong. The first clamp assemblies 57 are adapted to grasp opposite side edge portions of the sheet material 20 and upon moving the first clamp assemblies 57 in one direction along the rails 55 advance the sheet material through the stations.

Figures 2, 3:
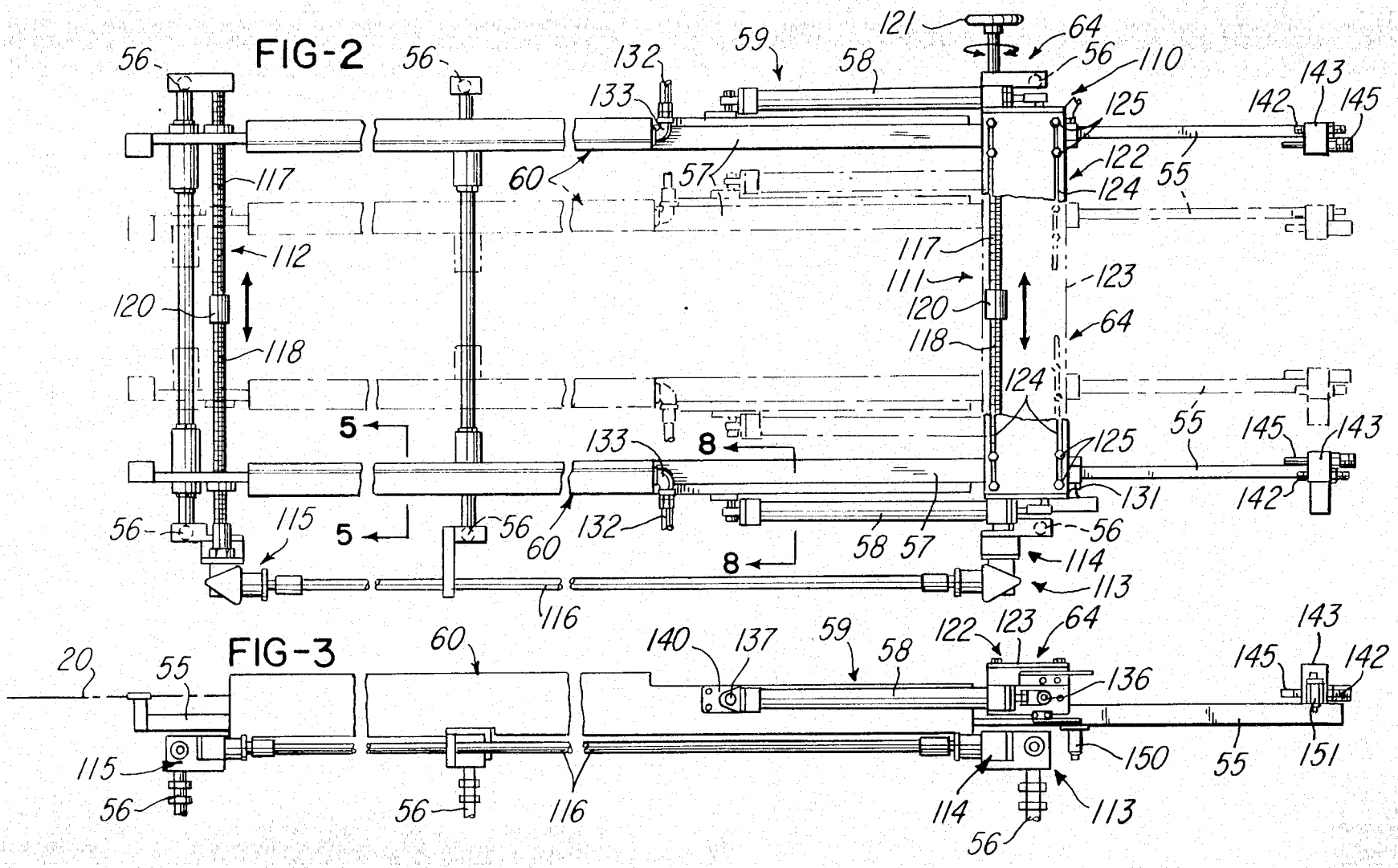
FIG. 2 is a top plan view primarily illustrating the rails of the machine of FIG. 1 together with a pair of first clamp assemblies, a pair of second clamp assemblies, and means for adjusting and holding the distance between the rails in a precise manner.
FIG. 3 is a side elevation of the components illustrated in FIG. 2.

The machine 10 also has means for moving the first clamp assemblies 57 along the rails. In this example such moving means comprises a pair of air cylinders each designated by the reference numeral 58 in FIGS. 1, 2, and 3. The clamp assemblies 57, air cylinders 58, and rails 55 may be considered as comprising conveyor means or a conveyor 59 for the sheet material 20, as shown in FIGS. 2 and 3.

The machine 10 also comprises a plurality of second clamp assemblies, each designated by the same reference numeral 60, and such second clamp assemblies 60 are mounted on the rails 55 in longitudinally fixed relation. Each clamp assembly 60 has an upper clamp member 83 and a lower clamp member 84 for grasping an associated side edge portion of the sheet material 20 transversly inwardly, independently, and in a non-interfering manner with an associated one of the first clamp assemblies 57, and as shown at 63 in FIG. 6, for example.

Figure 4:
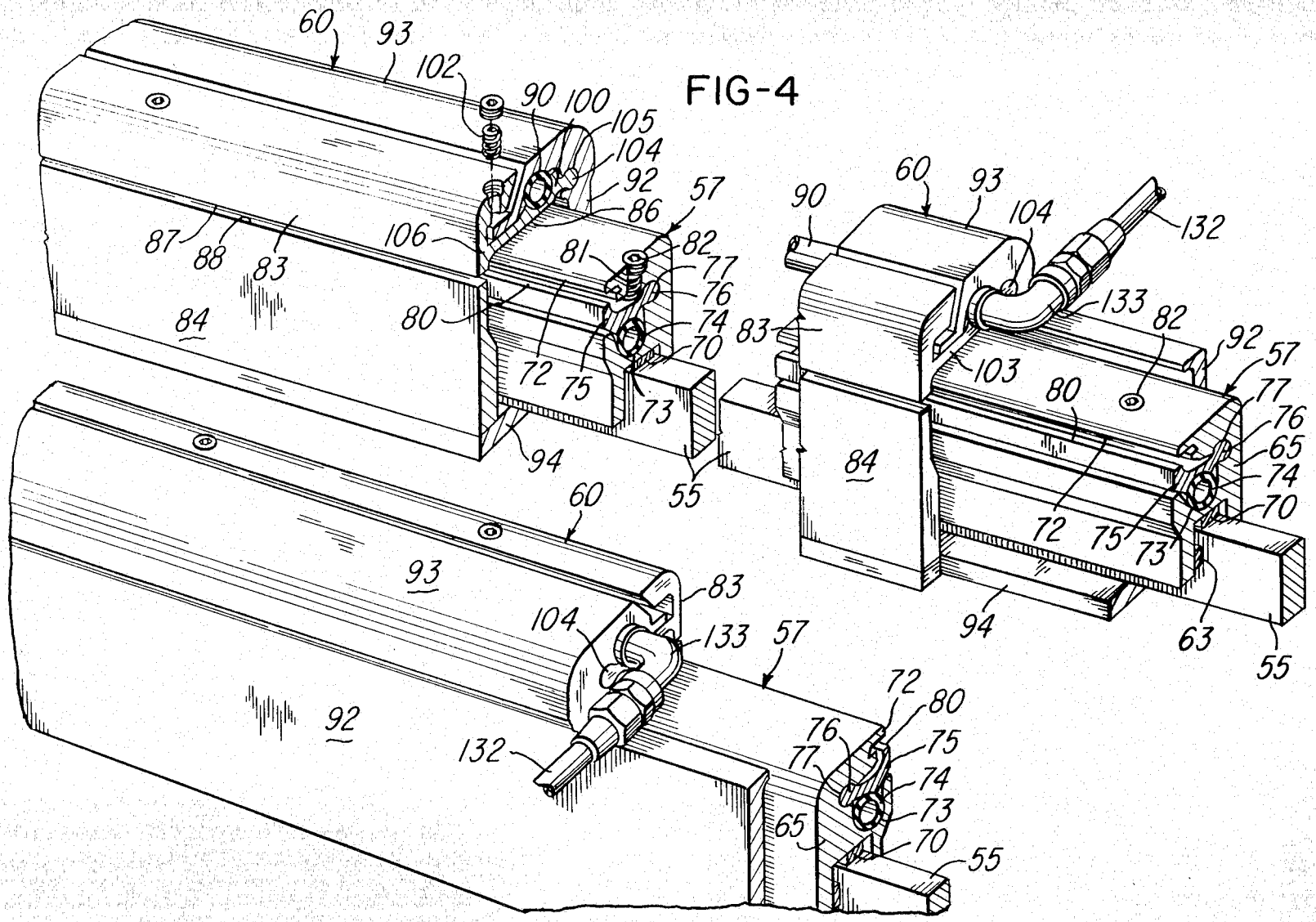
FIG. 4 is an enlarged isometric view with parts in cross section and parts broken away particularly illustrating the first and second clamp assemblies of the forming machine together with their supporting rails.

As best seen in FIG. 4 of the drawings and in accordance with the teachings of this invention, the upper and lower clamp members 83 and 84 of each clamp assembly 60 extend in a continuous uninterrupted manner substantially through or along the full extent of the working stations 30, 32, and 35 along the rails 55 and such members 83–84 are adapted to provide precise grasping and holding of opposite side edge portions of the sheet material along said full extent to enable modification of the sheet material at each successive station with optimum precision and yet without allowing slippage of such sheet material while it is being worked or undergoing physical modification at each working station.

Referring now to FIGS. 4–8 it is seen that the spaced apart rails 55 are of rectangular cross-section and mounted with their largest cross-sectional dimension vertically disposed. Each rail 55 has anti-friction strips 63 fixed to its opposed vertical surfaces which assure that its mounted clamp assembly 57 can be moved therealong in anti-friction manner.

In accordance with the teachings of this invention, the machine 10 may be provided with suitable means 64, as illustrated in FIGS. 2 and 3, for adjusting and holding the distance between the rails 55 in a precise manner. This means 64 will also be referred to as adjusting and holding apparatus 64 and will be described in detail subsequently.

Figure 5:
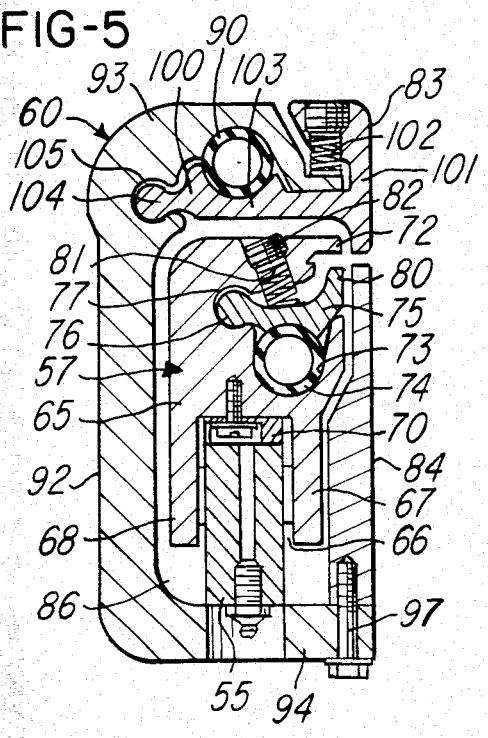
FIG. 5 is an enlarged cross-sectional view taken essentially on the line 5—5 of FIG. 2 showing an associated pair of clamp assemblies on their supporting rail and prior to receiving an associated side edge portion of sheet material therewithin.

Each clamp assembly 57 will now be described with particular reference to FIGS. 5 and 6 of the drawings. In particular, the clamp assembly 57 includes an inner clamp and an outer clamp. The inner clamp comprises a longitudinally extending rail-like clamp body member 65 which has a downwardly opening channel 66 for receiving an associated rail 55 therein. The body 65 is adapted to be moved longitundinally along its rail 55 and has a pair of depending flanges 67 and 68 which define opposite sides of the channel 66 and serve to guide the body 65 along its associated rail 55.

If desired, the rail 55 may be provided with a plurality of recessed rollers or the like which support the bottom of the body 65 in raised relation relative to the rail 55. However, in this example of the invention an anti-friction member 70 is suitably detachably fastened to the body 65 and such member 70 may be made of a suitable anti-friction material. In addition, the previously mentioned anti-friction strips or pads 63 fixed to opposite sides of the rail 55 provide guiding alignment for the body 65. The member 70 and pads 63 may be made of any suitable anti-friction material such as polytetrafluoroethylene or the like to enable anti-friction movement of each clamp assembly 57 along its rail.

The body 65 extends over the major part of the length of the machine 10 and along its associated rail 55 yet is mounted for longitudinal reciprocating movements along the rail together with the other components of its clamp assembly 57. Each clamp assembly 57 also comprises first clamping means in the form of a longitudinally extending clamping portion or lip 72 which is made as an integral part of the body 65 and such clamping lip 72 extends the full length of the body 65.

The body 65 also has a longitudinally extending substantially semi-cylindrical recess 73 extending the full length thereof and the recess 73 is particularly adapted to receive an elastomeric expansible tube 74 therewithin. The tube 74 may be reinforced by any suitable means known in the art to provide a controlled stretch to prevent such tube from splitting should it become overinflated.

The clamp assembly 57 also has a second clamping member 75 provided as a part thereof and the clamping member 75 also extends the length of the body 65 and has a central portion positioned in supported relation on the tube 74 so that it is supported thereby.

The clamping member 75 has an inner upwardly extending projection 76 pivotally received within a roughly semi-cylindrical channel 77 provided in the body 65. The clamping member 75 also has a forward end 80 which is turned upwardly and defines a lower clamping jaw 80 which cooperates with the clamping lip 72 to engage and grasp an associated side edge portion of the sheet material 20 therebetween to enable advancement of said sheet material through the machine 10 and hence the working stations thereof in a precise and efficient manner.

Each clamp assembly 57 has a plurality of adjustable compression springs 81 each positioned between the upper surface of the clamp member 75 and the member 65 adjacent its clamping lip 72. The springs are adjustable in compression by set screws 82 and once in position serve to normally urge the clamping jaw 80 and the clamping lip 72 apart.

The tube 74 comprises fluid expansible means positioned between the body 65 and the clamp member or lip 75 is operated by the introduction of fluid under pressure therewithin to thereby apply a substantially uniformly distributed force against the clamp member 75 causing it to move into closing relation by overriding the springs 81. Thus, the action of the tube 74, i.e., radial expansion thereof, causes movement of the clamping jaw 80 against the clamping lip 72 which provides a substantially uniform grasping and holding of an associated side edge portion of the sheet material. It will be appreciated that with assemblies 57 on both sides of the sheet material 20 a uniform grasping and holding is provided of both side edge portions of such sheet material. Accordingly, with both side edge portions of the sheet material grasped and held by the clamping assemblies 57 such assemblies are ready to be moved so that upon movement of the clamping members 57 along the rails 55, the web or sheet material 20 is moved uniformly along such rails 55 through the working stations.

Figure 7:
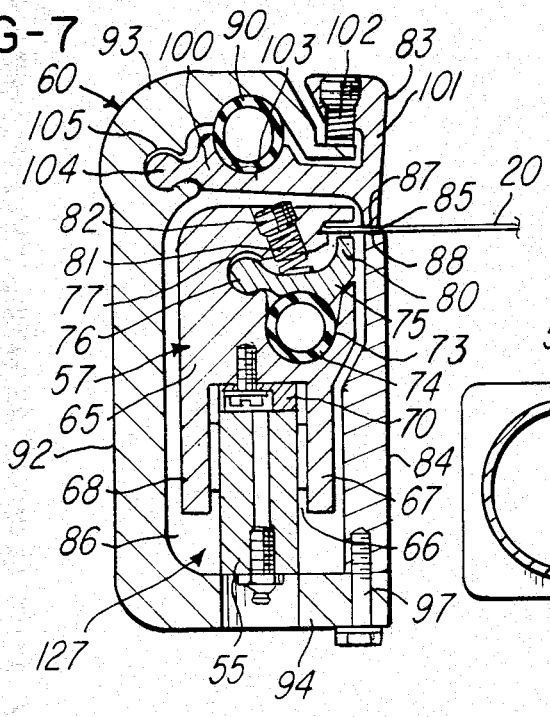
FIG. 7 is a cross-sectional view similar to and taken at the same position as the view of FIG. 5, illustrating the first clamp assembly in its inoperative or deactivated position and the second clamp assembly actuated.
Figure 8:
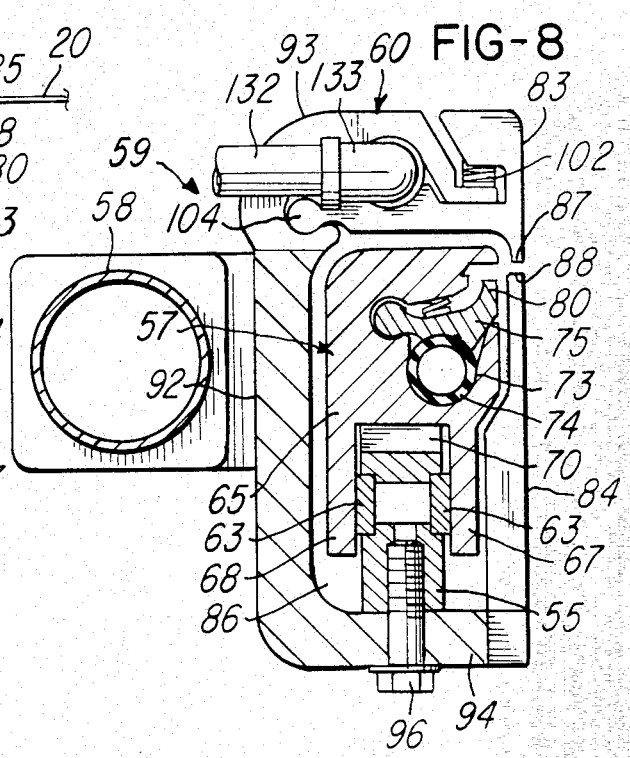
FIG. 8 is a cross-sectional view similar to FIG. 5 and taken essentially on the line 8—8 of FIG. 2.

As previously mentioned, the machine 10 comprises a pair of second clamp assemblies 60, the description of which will now proceed in connection with FIGS. 7 and 8 of the drawings. Each second clamp assembly 60 has an upper clamp member 83 and a lower clamp member 84 for grasping an associated side edge portion 85 of the sheet material 20 transversly inwardly, independently, and in a non-interfering manner with an associated one 57 of the first clamp assemblies. As will be readily apparent from FIGS. 1 and 4 of the drawings the upper and lower clamp members 83 and 84 respectively of each clamp assembly 60 extend in a continuous uninterrupted manner substantially along the full extent of the working stations 30, 32, and 35 along the rails 55.

The clamp members 83 and 84 of the clamp assemblies 60 are adapted to provide precise grasping and holding of opposite side edge portions of the sheet material 20 along the full extent of the working stations to enable modification of the sheet material 20 at each successive station with optimum precision and while allowing the first clamp assemblies 57 to be retracted and a new or fresh length of the web or sheet material introduced into the machine 10.

Each second clamp assembly 60 is fixed to an associated rail 55 and has a longitudinal passage 86 therethrough which enables reciprocating movements of its associated first clamp assembly 57 in a non-interfering manner as previously mentioned. It will be appreciated that the upper and lower clamp members 83 and 84 respectively engage and grasp the sheet material in sandwiched relation between a pair of planar parallel surfaces 87 and 88 respectively. (FIG. 8).

Each second clamp assembly 60 also has a longitudinally extending fluid expansible means in the form of an elongated elastomeric tube 90 which is suitably supported by an upper or lower clamp member 83 or 84 such that upon operating same by the application of fluid thereto a substantially uniformly distributed force is provided against at least one of the clamp members to urge same toward and against its associated side edge portion of the sheet material 20 to clamp such sheet material against the other clamp member thereby grasping and holding such associated side edge portion.

In this example, the tube 90 is radially expansible upon pressurizing the interior thereof with fluid under pressure and radial expansion of such tube causes pivoting movement of the upper clamp member 83 into engagement against an associated portion 85 of the sheet material to thereby clamp same against the lower clamp member 84.

The tube 90 has an effective length which corresponds to the length of its clamp members 83 and 84 whereby upon providing radial expansion of such tube a uniform clamping force is provided along the full length of the clamp members 83 and 84.

Referring now to FIGS. 4 and 8, it is seen that each of the second clamp assemblies 60 comprises a main supporting body 92 which extends in a continuous uninterrupted manner substantially along the full extent of the working stations of the machine 10 along the rails 55. In this example of the invention each main body is defined as a roughly C-shaped support 92 having a top transverse arm 93 (FIG. 6) and a bottom transverse arm 94 which, as shown in FIG. 8, has an inside surface disposed and detachably fixed against its associated rail 55 by plurality of threaded bolts 96 extending through spaced openings in the bottom transverse arm 94 into associated threaded openings which are aligned therewith in its associated rail 55.

Figure 6:
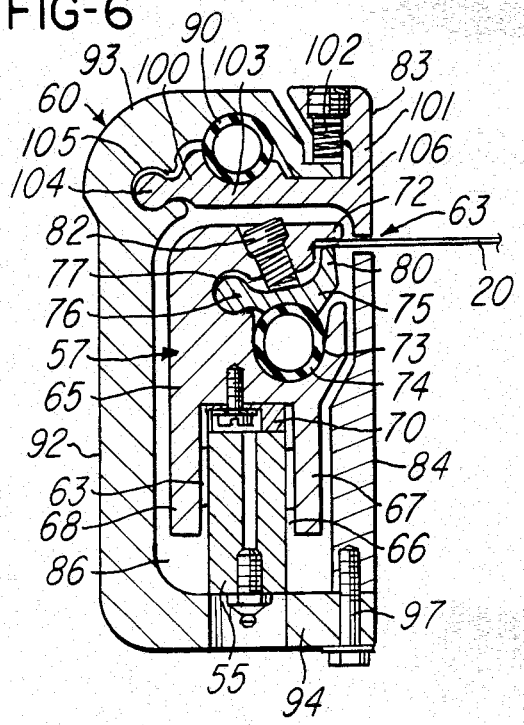
FIG. 6 is a cross-sectional view, similar to and taken at the same position as the view of FIG. 5, illustrating the first clamp assembly grasping and holding an associated side edge portion of the sheet material to enable conveying thereof through the working stations and along the rails.

As also seen in FIG. 6 the main body of C-shaped support 92 of each clamp assembly 60 has its associated lower clamp member 84 suitably detachably fastened to its bottom transverse arm 94 by a plurality of threaded bolts 97. The bolts 97 extend through spaced openings in the bottom transverse arm 94 and through associated aligned threaded openings in the lower portion of the lower clamp member 84.

The clamp assembly 60 also has its associated upper clamp member 83 pivotally supported by the top transverse arm 93 of the C-shaped support 92. Further, the construction and arrangement of the components of each clamp assembly 60 are such that the associated C-shaped support 92, lower clamp member 84, and upper clamp member 83, cooperate to define the associated longitudinal passage 86 through the clamp assembly 60 for receiving an associated first clamp assembly 57 therethrough for reciprocating movements.

Each upper clamp member 83 of each clamp assembly 60 has an inner end 100 (FIG. 6) pivotally supported by its C-shaped support 92 and an outer end 101. Spring means in the form of a plurality of adjustable spaced apart compression springs 102 are provided for normally yieldingly urging the outer end 101 away from its associated lower clamp assembly 84. However, as mentioned earlier, it will be seen that the elastomeric tube 90, upon radial expansion thereof, operates to override the spring means or springs 102 and pivots the outer end 101 toward the lower clamp member 84 to urge such outer end 101 against the associated side edge portion of the sheet material 20 as shown in FIG. 7.

Each upper clamp member 83 of each clamp assembly 60 is a substantially T-shaped member having a leg 103 defining the previously mentioned pivotally supported inner end 100 thereof and the leg 103 has a bulbous base 104. The C-shaped support 92 also has an elongated channel 105 defined along the full extent of such support and the bulbous base is pivotally supported in the elongated channel 105. It will be appreciated that the construction and arrangement of components is such that the T-shaped upper clamp member 83 with a bulbous base 104 on its leg 100 is disposed within the channel 105 by axial sliding movement thereof within and along the axis of such channel whereby once installed in position the member 83 can be removed only by similar axial sliding movement from either one end or the other of channel 105.

Each T-shaped member or upper clamping member 84 has a transverse bar 106 at the outer end of its leg 100 and such transverse bar 106 defines the outer end of the clamp assembly 83. It will be appreciated that with the construction and arrangement of the components of the clamp assembly 60 is such the associated elastomeric tube is disposed between the leg 103 of its associated T-shaped member 83 and the top transverse arm 93 of its associated C-shaped support 92.

As seen in FIG. 2 of the drawings the rails 55 of the machine 10 are disposed in spaced parallel relation, and in accordance with another aspect of this invention the machine 10 comprises means 110 for adjusting and holding the distance between the rails 55 in a precise manner. In particular, the means 110 comprise a plurality of sets of drive screws for adjusting the positions of the rails 55 at a corresponding plurality of longitudinal positions therealong.

The machine 10 of this example comprises two sets of drive screws with one set 111 being at one end portion of the rails and a second set 112 being at the opposite end portion of the rails. The machine 10 also has a linkage system, designated generally by the reference numeral 113, for connecting the plurality of sets of drive screws to enable adjusting all sets of screws in a substantially simultaneous manner. The exemplary linkage system 113 comprises a suitable gearbox assembly 114 operatively connected to the remote end of the set 111 of drive screws and a similar gearbox assembly 115 operatively connected to the remote end of the set 112 of drive screws. A suitable jack shaft 116 is operatively connected between the gearbox assemblies 114 and 115.

Each set of drive screws 111 and 112 comprises a right-hand drive screw 117 and a left-hand drive screw 118 suitably connected by coupling 120. Each drive screw 117 and 118 may be threaded through either a threaded opening in an associated rail 55 or preferably through a threaded opening in a component fixed to such rail such that upon rotating the screws in one direction the rails 55 are moved toward each other and upon rotating the screws in an opposite direction the rails 55 are moved away from each other.

The machine 10 of this example of the invention has adjusting and holding means 110 comprised of a single drive 121 for driving one of the set of screws 111 and the single drive 121 is shown as a manual drive wheel. In operation, rotating the wheel 121 in one direction or sense moves the rails closer together and rotating the wheel 121 in an opposite direction or sense moves the rails 55 farther apart. During this action it will be appreciated that the linkage system 113 assures that both ends of the rails are moved simultaneously and with precision.

The rails 55 are preferably provided with a suitable holding or lock assembly 122 fixed to the upper portions thereof. The assembly 122 may include a top plate 123 provided with a pair of parallel slots 124 and bolts 125 extending through the plate and being threaded into threaded openings in structures fixed to the rails 55. The rails 55 may be readily moved or adjusted either toward each other or away from each other upon loosening bolts 125; and, once such rails have been disposed with the desired spacing therebetween such bolts 125 may be tightened to firmly fix the rails 55 to their adjusted positions.

Reference is again made to FIG. 6 of the drawings which shows a first clamp assembly 57 grasping and holding an associated side edge portion of the sheet material 20. The clamp assemblies 57 operate to move or convey the sheet material through the working stations and the conveying is achieved in an indexing manner. However, once the sheet material is moved a predetermined distance in the indexing manner mentioned above the second clamp assemblies 60 are moved into clamping engagement and for a time increment of a second or less both the first 57 and second 60 clamp assemblies engage the sheet. However, once the second clamp assemblies 60 are brought into clamping and holding engagement as illustrated in FIG. 7 the first clamp assemblies 57 are released whereby at this point in the operating cycle the clamp assemblies 57 are released and moved toward supply roll 18. Simultaneously, the length of sheet material indexed or moved into its associated working stations is worked during retracting movements of the clamp assemblies 57 whereby there is a substantial increase in speed of operation of machine 10 over the machine described in the above-mentioned patent. Further during working of the sheet material 20 at all stations the clamp assemblies 60 hold the sheet material firmly in position by grasping and holding the opposite side edge portions the full extent of the working stations 30, 32, and 35. It will be appreciated that during the grasping and holding of the opposite side edge portions of the sheet material 20 by the second clamp assemblies 60 there is considerable space or clearance between each assembly 60 and its associated assembly 57. This space may be seen at 127 in FIG. 7, for example, and assures that the assemblies 57 can move freely.

Fluid under pressure is supplied to expansible tube 74 of each clamp assembly 57 and in this example of the invention such fluid is preferably air under pressure which is supplied from an air source through a flexible conduit 130 which is suitably operatively connected to the tube 74 by a fitting 131. Similarly, fluid under pressure is supplied to the expansible tube 90 of each clamp assembly 60 and again such fluid under pressure is preferably air which is supplied from an air source through a conduit 132 which is suitably operatively connected to the tube 90 by a fitting 133. The source of air under pressure which is provided to the inlets of the conduits 130 and 132 may be any suitable source and control means may be used to control the magnitude of the pressure as is known in the art. It will also be appreciated that instead of air any fluid may be used such as a gas, a liquid or a combination of a gas and liquid. It will also be appreciated that the opposite ends of the expansible tubes 74 and 90 comprising the clamp assemblies 57 and 60 respectively are suitably closed or blocked by end plates (not shown), or the like.

Means is provided for moving the first clamping assemblies 57 along the rails 55 after grasping the side edge portions of the sheet material 20 to advance such sheet material through the working station to enable performing the various previously described operations on such sheet material. Although any suitable known means may be provided, in this example of the invention such moving means comprises a pair of the previously mentioned air cylinders 58 and such air cylinders are illustrated in FIG. 3 of the drawings. Each air cylinder has one end operatively connected to a clamp assembly 57 by a suitable connection 136 and an opposite end 137 suitably mounted to an associated rail 55 by a connecting structure 140.

The air cylinders 58 have operating rods which extend and retract parallel to the associated rails 55. The air cylinders 58 may be provided with suitable cam surfaces, valves, controls, and the like as is known in the art to control the movement and stroke and such controls may be to cushion, slow down, and stop the movement of the clamp assemblies 57 once they reach their precise extended and retracted positions.

The extended limit position of the movable conveyor defined by the first clamp assemblies 57 and air cylinders 58 is defined and precisely controlled by a pair of threaded rods 142 each associated with a rail 55. The threaded rods 142 are mounted on the ends of the rails 55 by means of support brackets 143 and serve as precise stops, and the stop position may be adjusted by threading the rods 142 along their support brackets.

The movement of the clamp assemblies 57 into stops 142 is also cushioned by a pair of shock absorbers 145, and each shock absorber 145 is suitably supported on an associated support bracket 143. Further, the shock absorbers 145 may be of any suitable type known in the art.

Suitable controls may be provided in association with the extension and retraction of the air cylinders 58 and the like as is known in the art to control the movement of the conveyor 59.

The air cylinders may be provided with air from any suitable air source such as a source of shop air. The source of shop air may be controlled in pressure by suitable adjustable air pressure regulators and like components as known in the art. Such conduits will not be illustrated in the drawings.

As suggested above, the parallelism of movement of the clamp assemblies 57 and, in essence, the conveyor defined by clamp assemblies 57 and the air cylinders 58 is controlled in this invention by the assembly 122. The assembly 122 also serves to hold the rails 55 to their adjusted positions as adjusted by the adjusting means 110 previously described.

Means may also be provided for signalling the fact that the conveyor has moved either to its forward or reverse position, and in this example suitable limit switches 150 and 151 respectively (FIG. 3) are provided. However, if desired, such means may include a downwardly depending plate or the like attached to the assembly 122. Such a plate is not shown but may be the same as in the above-described patent and may be associated with a suitable plate upon which limit switches may be mounted at opposite ends thereof. The limit switches may be adjustably mounted with one limit switch indicating the forward position of the clamp assemblies 57 as moved by the air cylinders 58 and another switch indicating the retracted position of the clamp assemblies 57 as moved by such air cylinders 58. The switches, valves for the air cylinders, and the like may be of any suitable known type and may be operatively connected by suitable connections (not shown) to a control panel 147.

Having presented the detailed construction, arrangement, and operation of the machine 10 and its components the detailed description will now proceed with a general description of the overall operation of such machine. In particular, a roll 18 of sheet material 20 is initially threaded in position through the clamping rolls 21, dancer roll 24, and so that a portion of sheet material extends just past the preheating station. The machine 10 has automatic control means controlled through control panel 147 which has suitable circuitry therein (not shown) and also suitable connections to the components and their control devices, none of which are shown, but are well-known in the art. Upon starting the machine 10 in its automatic cycle, the apparatus 31 at the preheating station 30 heats a portion of the sheet material 20. During heating the clamp assemblies 60 hold opposite side edge portions of the sheet material firmly in position; and, simultaneously during the heating action the clamp assemblies 57 are moved to their retracted positions by the air cylinders 58.

Once the heating action is completed the clamp assemblies 57 are actuated, the clamp assemblies 60 are released, and the air cylinders 58 again actuated whereby the preheated portion is moved to the forming station 32 for forming thereof by the apparatus 33 and a new length of sheet material is moved into the preheating station 30 for heating. This procedure is repeated until sheet material extends throughout the machine and the portion of sheet material at the stacking station 42 has been serially moved and processed through all of the working stations 30, 32, and 35. Thus, sheet material is present at all stations 30, 32, 35 and 42 in various stages of processing. At this point in the operation of the machine further advancing movements of the sheet material 20 utilizing the clamp assemblies 57 and air cylinders 58 simultaneously moves a new length or portion of sheet material to the preheating station 30, a previously preheated portion to the forming station 32, a previously formed portion to the severing and scoring station 35, and a severed and scored portion to the stacking station 42. It will be appreciated that these stations are spaced apart equal distances and indexing movement of the sheet material 20 by the clamp assemblies 57 and air cylinders 58 and the associated controls precisely aligns each portion at its next station to enable working thereon.

The working or processing action which is taking place is done in a simultaneous manner at all stations with the clamp assemblies 60 grasping and holding opposite side edge portions of the sheet material 20 along the full length of such sheet material through all of the working stations whereby a precise holding is taking place with no parts of the sheet material free to slip, slide, or distort by stretching. During the simultaneous working at all working stations and with the clamp assemblies 60 performing their holding function, the clamp assemblies 57 are moved to their upstream position by air cylinders in readiness for grasping a new length of sheet material. Once the working is complete the clamp members 57 grasp and hold a new portion of sheet material and all previously formed portions in preparation for repeating the cycle once the clamp members 60 are released. It will be appreciated that movement of clamp assemblies 57 while the sheet material is being worked in a simultaneous manner at all stations increases the speed of operation of machine 10 over previous machines.

In addition to increased speed of operation during forming the holding of the sheet material 20 by the clamp assemblies 60 along the full extent of its length without gaps or spaces between the points of holding engagement makes possible forming with precise dimensional tolerances. In particular, whereas alignment from station to station in the machine described in the above-mentioned patent resulted in some package portions varying in dimensional size of the order of 0.015 inch or more, in the machine of this invention with its improved clamp assemblies and moving system the package portions do not vary in dimensional size by more than 0.005 inch.

Thus, the improved machine of this invention with its improved clamp assemblies 57 and 60 provides an increase in accuracy in the forming of packages 11 because it minimizes or prevents shrinkage and slippage during forming and increases the speed of operation of forming such packages.

It will also be seen that the moving components of the inner and outer ends of the clamp assemblies 57 and 60 are of optimum simplicity and lend themselves to rapid action with minimum likelihood of down time due to the need for maintenance, or the like. In addition, the components of the clamp assemblies 57 and 60 are such that they may be precisely made by metal extrusion process.

In this disclosure of the invention, the various power sources for various components, detailed connection for controls of the components, and the like have not been illustrated and described. However, it is to be understood that these items are suitably operated and controlled and provided with power from suitable sources as required and as is known in the art.

In this disclosure of the invention, terms such as upper, lower, inner, outer, top, bottom, and the like, have been used. However, it is to be understood that these terms are used to describe components as illustrated in the drawings and are not to be considered limiting in any way.

While present exemplary embodiments of this invention, and methods of practicing the same, have been illustrated and described, it will be recognized that this invention may be otherwise variously embodied and practiced within the scope of the following claims.

What is claimed is:

1. In a forming machine in which sheet material is advanced serially through a succession of working stations for physical modification of said sheet material; said machine comprising: a pair of spaced apart rails extending along said stations; a pair of first clamp assemblies each mounted on an associated one of said rails for reciprocating movements therealong; said first clamp assemblies grasping opposite side edge portions of said sheet material and upon moving said first clamp assemblies in one direction along said rails advance said sheet material through said stations; means for moving said first clamp assemblies along said rails; a plurality of second clamp assemblies mounted on said rails in longitudinally fixed relation; each of said second clamp assemblies having an upper and a lower clamp member for grasping an associated side edge portion of said sheet material transversely inwardly, independently, and in a non-interfering manner with an associated one of said first clamp assemblies; the improvement in which the upper and lower clamp members of each of said second clamp assemblies extend in a continuous uninterrupted manner substantially the full extent of said stations along said rails and provide precise grasping and holding of opposite side edge portions of the sheet material along said full extent to enable modification of the sheet material at each successive station with optimum precision; said rails of said pair of rails being disposed in parallel relation; and further comprising; means for adjusting and holding the distance between said rails in a precise manner, said means for adjusting and holding comprising a plurality of sets of drive screws for adjusting the positions of said rails at a corresponding plurality of positions therealong, and a linkage system for connecting said plurality of sets of screws to enable adjusting all sets of screws in a simultaneous manner.

2. A machine as set forth in claim 1 and further comprising a single drive for driving one of said sets of drive screws and hence all sets of screws through said linkage system.

3. In a forming machine in which sheet material is advanced serially through a succession of working stations for physical modification of said sheet material, said machine comprising: a pair of spaced apart rails extending along said stations; a pair of first clamp assemblies each mounted on an associated one of said rails for reciprocating movements therealong; said first clamp assemblies grasping opposite side edge portions of said sheet material and upon moving said first clamp assemblies in one direction along said rails advance said sheet material through said stations; means for moving said first clamp assemblies along said rails; a plurality of second clamp assemblies mounted on said rails in longitudinally fixed relation; each of said second clamp assemblies having an upper and a lower clamp member for grasping an associated side edge portion of said sheet material transversely inwardly, independently, and in a non-interfering manner with an associated one of said first clamp assemblies; the improvement comprising, means for adjusting and holding the distance between said rails in a precise manner, said means for adjusting and holding comprising a plurality of sets of right and left hand drive screws for adjusting the positions of said rails at a corresponding plurality of positions therealong, and a linkage system for connecting said plurality of sets of screws to enable adjusting all sets of screws in a simultaneous manner.

* * * * *